US011192166B2

(12) United States Patent
Geiger et al.

(10) Patent No.: US 11,192,166 B2
(45) Date of Patent: Dec. 7, 2021

(54) BLANKING PUNCH

(71) Applicant: Bayerische Motoren Werke Aktiengesellschaft, Munich (DE)

(72) Inventors: Michael Geiger, Hebertshausen (DE); Nathanael Sutter, Hoehenkirchen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/551,939

(22) Filed: Aug. 27, 2019

(65) Prior Publication Data

US 2019/0381554 A1 Dec. 19, 2019

Related U.S. Application Data

(63) Continuation of application No. PCT/EP2018/050651, filed on Jan. 11, 2018.

(30) Foreign Application Priority Data

Feb. 28, 2017 (DE) ..... 10 2017 203 231.6

(51) Int. Cl.

| | |
|---|---|
| ***B21D 28/34*** | (2006.01) |
| ***B21D 35/00*** | (2006.01) |
| ***B21D 45/00*** | (2006.01) |

(52) U.S. Cl.

CPC ..... *B21D 28/34* (2013.01); *B21D 35/007* (2013.01); *B21D 45/003* (2013.01)

(58) Field of Classification Search

CPC .... B21D 28/34; B21D 35/007; B21D 45/003; B21D 45/06; B21D 45/00; Y10T 83/06; Y10T 83/764; Y10T 83/8788

See application file for complete search history.

(56) References Cited

U.S. PATENT DOCUMENTS

| | | | | |
|---|---|---|---|---|
| 1,784,911 A | | 5/1927 | Schlitters, Jr. et al. | |
| 1,969,426 A | * | 8/1934 | Ross | B21D 28/34 83/140 |
| 2,221,904 A | * | 11/1940 | Abramson | B21D 28/343 30/360 |

(Continued)

FOREIGN PATENT DOCUMENTS

| | | |
|---|---|---|
| CN | 105 363 894 A | 3/2016 |
| DE | 1 993 915 U | 9/1968 |

(Continued)

OTHER PUBLICATIONS

International Search Report (PCT/ISA/210) issued in PCT Application No. PCT/EP2018/050651 dated Mar. 21, 2018 with English translation (six (6) pages).

(Continued)

*Primary Examiner* — Ghassem Alie
*Assistant Examiner* — Fernando A Ayala
(74) *Attorney, Agent, or Firm* — Crowell & Moring LLP

(57) ABSTRACT

A blanking punch which extends from a first portion to a second portion along a blanking direction is provided. The second portion has a cutting edge. An engaging portion is provided/designed between the first portion and the second portion. The engaging portion enables the blanking punch to be removed from a workpiece counter to the blanking direction.

17 Claims, 2 Drawing Sheets

(56) References Cited

U.S. PATENT DOCUMENTS

| | | | | | |
|---|---|---|---|---|---|
| 4,380,871 | A * | 4/1983 | Adleman | B23D 29/02 | 30/360 |
| 4,487,566 | A * | 12/1984 | Barna | B21D 28/34 | 279/91 |
| 5,970,838 | A * | 10/1999 | Perazzolo | B21D 28/12 | 83/552 |
| 2013/0091920 | A1* | 4/2013 | Breen | B21D 37/08 | 72/404 |
| 2013/0240264 | A1* | 9/2013 | Barezzani | B21J 15/04 | 174/71 B |
| 2013/0340588 | A1* | 12/2013 | Qi | B21D 28/346 | 83/698.31 |

FOREIGN PATENT DOCUMENTS

| | | | |
|---|---|---|---|
| FR | 1093388 | A | 5/1955 |
| GB | 2 084 066 | A | 4/1982 |
| JP | 2017-1065 | A | 1/2017 |

OTHER PUBLICATIONS

German-language Written Opinion (PCT/ISA/237) issued in PCT Application No. PCT/EP2018/050651 dated Mar. 21, 2018 (five (5) pages).

German-language Search Report issued in counterpart German Application No. 10 2017 203 231.6 dated Nov. 21, 2017 with partial English translation (11 pages).

* cited by examiner

BLANKING PUNCH

CROSS REFERENCE TO RELATED APPLICATIONS

This application is a continuation of PCT International Application No. PCT/EP2018/050651, filed Jan. 11, 2018, which claims priority under 35 U.S.C. § 119 from German Patent Application No. 10 2017 203 231.6, filed Feb. 28, 2017, the entire disclosures of which are herein expressly incorporated by reference.

BACKGROUND AND SUMMARY OF THE INVENTION

The present invention relates to a blanking punch, a blanking mandrel, a blanking tool, a blanking set, and a method for blanking.

In body and vehicle construction, use is increasingly being made of high-strength metal sheets, in particular including multilayer high-strength metal sheets. These make it harder to use known blanking tools, since very high forces are required in order to withdraw the blanking punch again after blanking. It is particularly multilayer metal sheets that are problematic here, in particular when different materials are used, for example aluminum and steel, since the different layers have different flow properties. Although blanking tools are also known that are quite capable of providing high withdrawal forces, for example via appropriately designed hydraulics, the problem or risk exists of the blanking punch breaking off while it is being pulled out or withdrawn, on account of the brittleness thereof.

Therefore, it is an object of the present invention to specify a blanking punch, a blanking mandrel, a blanking tool, a blanking set, and a method for blanking, which remedy the abovementioned drawbacks and at the same time are simple and cost-effective.

This and other objects are achieved by a blanking punch, a blanking mandrel, a blanking tool, a blanking set, and a method for blanking in accordance with embodiments of the invention. Further advantages and features can be gathered from the claims and from the description and the appended figures.

According to an embodiment of the invention, a blanking punch extends from a first portion to a second portion in a blanking direction, wherein the second portion has a cutting edge and wherein, between the first portion and the second portion, an engaging portion is provided or formed, which allows the blanking punch to be removed from a workpiece counter to the blanking direction. Thus, advantageously, the engaging portion provides the possibility, directly at the blanking punch, of pulling or pushing the blanking punch out of, or removing it from, the workpiece after punching, wherein, for this purpose, in particular a suitable tool is used and not the blanking tool itself. With respect to a longitudinal axis of the blanking punch, the engaging portion is preferably circumferential and, considering an overall length of the blanking punch, also arranged approximately centrally, this proving advantageous for the stability of the blanking punch. Advantageously, the blanking punch is short with respect to its diameter, with the result that breaking off can be efficaciously avoided effectively just through the basic shape of the blanking punch. According to a preferred embodiment, the second portion, which forms or includes the cutting edge, is round, in particular circular, or oval, triangular, quadrilateral, or generally polygonal etc. This also goes analogously and in a corresponding manner for the shape or geometry of the cutting edge. Preferably, the first portion is also formed in a round, in particular circular, manner, but can likewise have different geometries.

Typical diameters of the second portion, or of a cutting edge in the form of a circular ring, are in a range of about 2-12 mm, preferably in a range of about 4-10 mm. In this case, a length of the blanking punch is about 10-40 mm, preferably about 15-20 mm. Depending on the diameter or a diagonal of the cutting edge, other lengths are also realizable, however.

Preferably, a ratio of a length of the blanking punch to the diameter thereof is in a range of about 1 to 10, particularly preferably in a range of about 1 to 6, or even in a range of about 1 to 4. The diameter is understood to mean in particular the diameter of the second portion or of the cutting edge, or the corresponding diagonal when the cross section is not circular.

As regards the material used, typical cutting materials, for example made of metal and/or ceramic, are proposed. Preference is given to the use of metal, for example steel or carbide. Hardened tool steel is particularly preferred on account its easy production, its low tendency to break and its acceptable wear resistance. High-speed steel (HSS) is likewise suitable, in particular since its wear resistance is higher than in hardened tool steel, but its tendency to break is higher and it is more expensive to produce.

According to one embodiment, the engaging portion is round, in particular circular, in cross section, wherein the engaging portion has at least one circumferentially arranged engaging element that is oriented in an inclined manner along the longitudinal axis of the blanking punch. The engaging element can be in the form of a protrusion and/or recess, which extends substantially obliquely to the longitudinal axis. For example, the engaging element is in the form of a groove or slot or in the form of a rib, etc. In principle, the engaging portion, or the at least one engaging element, is designed or configured such that a circumferential force that is applied to the engaging portion by a tool and acts on the engaging portion, or on the at least one engaging element, substantially tangentially and transversely to the longitudinal axis is converted or diverted into a force that acts on the blanking punch counter to the blanking direction, with the result that, ultimately, it is possible to push or pull the blanking punch out of the workpiece after blanking.

It should be emphasized that the force that acts circumferentially on the engaging portion does not act at points but preferably circumferentially on account of the geometry thereof, with the result that, in particular, very exact pulling or pushing out along the longitudinal axis occurs without any jamming or the like.

According to a preferred embodiment, the engaging portion is in the form of a thread. Such a configuration is particularly advantageous, since the production of threads is a tried-and-tested manufacturing procedure. In addition, the tool force that is necessary to pull the blanking punch out of the workpiece can be set very precisely for example via the pitch of the thread. According to a preferred embodiment, the thread is a metric thread, for example an M8 thread.

Preferably, a diameter of the first portion is smaller than an outside diameter of the engaging portion. This configuration makes it easier to arrange a punch receptacle, as described below, or an (extraction) tool that is intended to be positioned on the engaging portion, in particular on the thread, in order to remove the blanking punch from a workpiece. In other words, the tool (or the punch receptacle) can be pushed easily over the first portion in order then to screw it on, for example in the case of a thread.

Expediently, a diameter of the second portion is smaller than an outside diameter of the engaging portion. This advantageously makes it possible to use an extraction tool of simple construction, which is described in more detail in the following text.

According to one embodiment, the first portion has, for example at its end and/or circumference, an engaging region for the arrangement of a tool. For example, a slot, a cross slot or a hexagon socket, which serves for the arrangement of a corresponding tool, is arranged at the end. Circumferentially, the first portion can likewise be shaped such that it is possible to position for example a socket thereon. Advantageously, the engaging region serves to screw the blanking punch for example out of an extraction tool, or, depending on the configuration, of a corresponding punch receptacle for arrangement therein.

According to one embodiment, the blanking punch is configured such that the first portion also has a cutting edge. In this case, the first and the second portion may have different diameters or different geometries, such that different contours can be blanked with a blanking punch. Alternatively, the two cutting edges are also configured identically, wherein the blanking punch can be turned round when one of the edges has become worn, etc.

The invention also relates to a blanking mandrel including a blanking punch according to the invention and a punch receptacle in which the blanking punch is arranged or arrangeable.

According to one embodiment, an extension, in particular in the form of a point or of a cone, is arranged or provided on the end of the second portion. As a result, the blanking forces can advantageously be reduced. Further advantages of the point are the centering action between the punch and die and the centering/positioning during placement on the metal sheet/workpiece.

Expediently, the blanking punch can be arranged in the punch receptacle in a form- and/or force-fitting manner. According to one embodiment, a, possibly circumferential, groove is provided for example in the region of the first portion, said groove cooperating with a spring-loaded ball or a snap ring that is provided in the punch receptacle.

According to a preferred embodiment, the blanking punch is arranged or arrangeable in the punch receptacle via the engaging portion, i.e. in particular via the thread. This allows a particularly simple structure of the blanking mandrel, since in particular the blanking punch has to have few functional faces.

Preferably, the blanking punch is screwed into the punch receptacle. The punch receptacle is expediently designed such that the second portion of the blanking punch projects entirely or at least partially out of the punch receptacle in the blanking direction.

According to one embodiment, the punch receptacle includes a pressure shoulder or forms the latter, wherein the pressure shoulder forms or comprises substantially a support face that extends perpendicularly or substantially perpendicularly or transversely to the longitudinal axis and is designed to ensure the transmission of the blanking force, entirely or at least partially, from the punch receptacle to the blanking punch, in particular to the first portion.

The invention also relates to a blanking tool comprising a blanking mandrel according to the invention. In particular, the blanking tool is a hand tool as is used for example in workshops for vehicle repair or body repair of motor vehicles. The basic design of such a tool, including a die etc., is known from the prior art and is therefore not described in more detail in the present text.

The invention also relates to a blanking set including a blanking tool according to the invention and an extraction tool, wherein the extraction tool has an arranging portion corresponding to the engaging portion of the blanking punch, and a stop. Expediently, the arranging portion is in the form of a thread corresponding to the engaging portion.

According to one embodiment, the extraction tool is designed to effect pulling or pushing of the blanking punch out of a workpiece by rotation. This pulling or pushing out is effected in particular in that the extraction tool can be supported via the stop, in particular on the workpiece or on the very surface of the workpiece that is being blanked. In this case, the tangentially or circumferentially acting force that acts or is applied by the rotation of the extraction tool and would in principle cause the extraction tool to move in the direction of the workpiece surface is converted/diverted into a force that pushes out the blanking punch counter to the blanking direction. At this point, it should be mentioned that it is basically unimportant whether the thread is in the form of a left-hand thread or of a right-hand thread.

According to one embodiment, the extraction tool is at least regionally in the form of a sleeve or substantially in the form of a sleeve, wherein the stop is in the form of a stop face on the end of the sleeve. In particular, the stop face is formed in an annular manner and oriented substantially perpendicularly to the longitudinal axis.

According to one embodiment, the arranging portion is, as already mentioned, in the form of a threaded portion, wherein the arranging portion is preferably at least as long as the engaging portion, for example 1.5 or 2 times as long. This has the advantage that the blanking punch is retained in the extraction tool after it has been screwed out of the workpiece. In order to remove the blanking punch from the extraction tool, it is advantageously possible to use the engaging region, present at the end of the first portion, of the blanking punch.

The invention also relates to a method for blanking, in particular for blanking metal sheets, in particular multilayer and possibly also high-strength metal sheets, wherein a blanking punch is used, which initially remains in the workpiece after blanking, wherein the blanking punch circumferentially has an engaging portion, and wherein the blanking punch is removed from the workpiece counter to a blanking direction by means of the engaging portion after blanking.

Expediently, the method includes the step whereby, after the actual blanking operation, a punch receptacle that serves for the arrangement of the blanking punch during blanking is removed, in particular, in the case of an engaging portion in the form of a thread, unscrewed. All that then remains in the workpiece or in the blanked hole is the blanking punch.

Expediently, the method includes the steps of:

arranging an extraction tool on, in particular screwing same onto, the engaging portion until a stop has been reached, on which the extraction tool can be supported, wherein the stop is formed in particular by the workpiece surface of the workpiece; and further arranging the extraction tool, in particular rotating same further, such that or with the result that the blanking punch is pushed out of the workpiece.

Expediently, as a result of the geometry or the cooperation of the blanking punch with the extraction tool, the removal of the blanking punch is thus effected counter to the blanking direction. It is particularly advantageous here that, as a result of the use of the extraction tool or of the cooperation of the arranging portion thereof with the engaging portion of the blanking punch, a force is generated that acts exactly or substantially exactly along the longitudinal axis. In this respect, no jamming or the like of the blanking punch occurs, this both proving advantageous for the quality of the blanked hole and keeping the forces required for removal low.

As a result, an effective blanking method can be realized with an extremely simple mechanical structure. Blanking tools that provide high withdrawal forces are no longer necessary, since the geometry of the blanking punch allows a completely different approach.

For the blanking mandrel according to the invention, the blanking tool according to the invention, the blanking set according to the invention, and for the method according to the invention, the advantages and features mentioned in connection with the blanking punch apply analogously and in a corresponding manner and vice versa and in combination with one another. Further features and advantages will become apparent from the following description of a blanking punch and of a blanking mandrel and of a blanking tool and of a method with reference to the appended figures.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
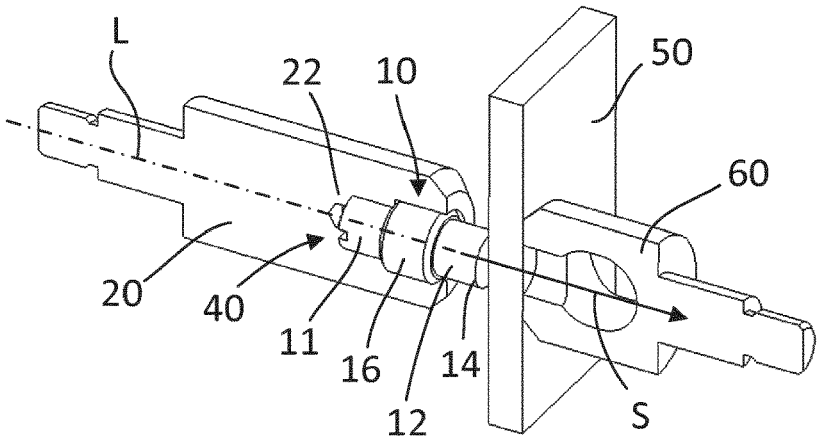
FIG. 1 is an arrangement of a blanking punch together with a die on a workpiece in a perspective illustration before blanking.

FIG. 1 shows a perspective illustration, illustrated partially in section, of a blanking mandrel including a punch receptacle 20, in which a blanking punch 10 is arranged. The entire arrangement extends along a longitudinal axis L, wherein the reference sign S and the corresponding arrow indicate a blanking direction. The blanking mandrel is arranged on a workpiece 50, for example on a (multilayer) metal sheet, wherein, on the opposite side from the blanking mandrel, a die 60 bears against the workpiece or metal sheet 50. The blanking punch 10 includes a first portion 11 and a second portion 12, wherein an engaging portion 16 is arranged in between. According to a preferred embodiment, the latter has an external thread or is formed as a thread, although this is not shown in the illustration sketched here for reasons of clarity. The second portion 12 includes a round, in particular circular, cutting edge 14, while the first portion 11 has an engaging region 40, which is discernible as a small slit in FIG. 1. The reference sign 22 furthermore indicates a pressure shoulder of the punch receptacle 20, which serves to transmit the blanking force into or onto the blanking punch 10 ultimately via the punch receptacle 20 and to distribute it more uniformly (and for example not just via the engaging portion 16 of the blanking punch 10).

Figure 2:
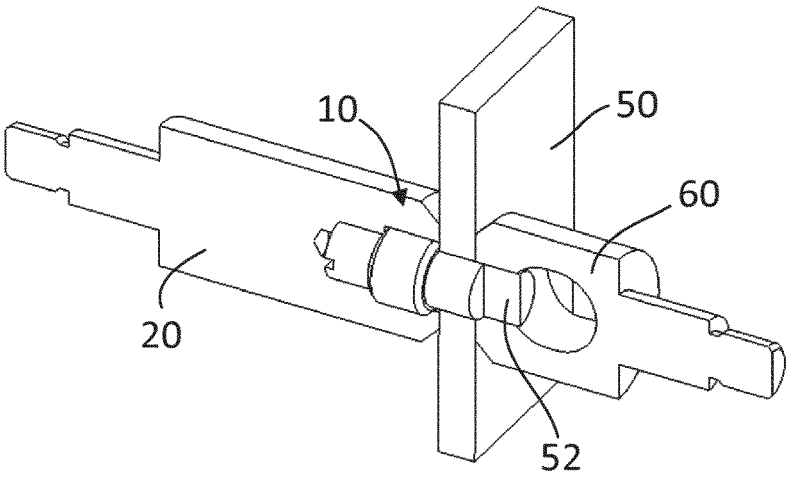
FIG. 2 is the configuration from FIG. 1 after the blanking operation.

FIG. 2 shows substantially the configuration known from FIG. 1 after the blanking operation. The blanking punch 10 has, in this view, passed through the workpiece 50 and formed a blanked slug 52, which is or can be collected for example by the die 60. The punch receptacle 20 can now be removed, in particular unscrewed, from the blanking punch 10, which sits in the workpiece 50.

Figure 3:
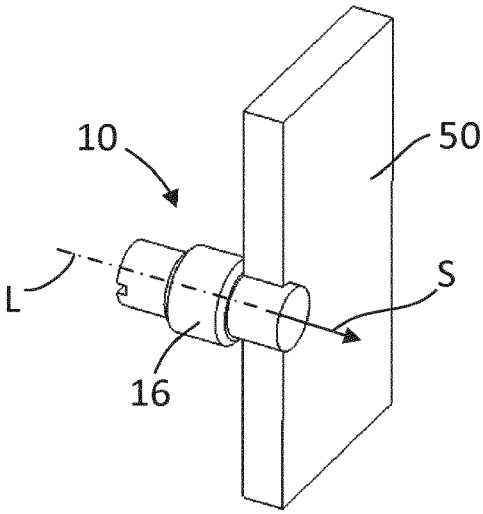
FIG. 3 is the blanking punch from FIGS. 1 and 2, as is arranged in the workpiece after blanking.

FIG. 3 shows the blanking punch 10 after removal of the punch receptacle 20. Expediently, the engaging portion 16, which is preferably in the form of a thread or comprises a thread, now allows the blanking punch 10 to be removed counter to the blanking direction S.

Figure 4:
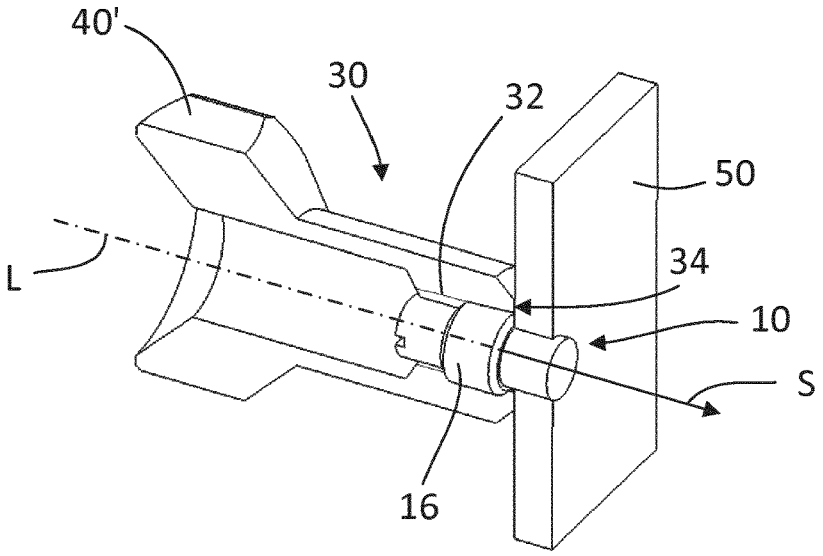
FIG. 4 shows the cooperation of an extraction tool with the blanking punch known from FIGS. 1 to 3.

In FIG. 4, an extraction tool 30 has now been arranged on the blanking punch 10. In particular, the extraction tool 30 has been screwed on, wherein, for this purpose, it has an arranging portion 32 that has a geometry corresponding to the engaging portion 16, i.e. in the present case is preferably in the form of an internal thread. The extraction tool 30 is substantially in the form of a sleeve, wherein it ends in the blanking direction S with a stop or a stop face 34 that bears against a surface of the workpiece 50. Said surface forms so to speak the counter-stop. If, in this configuration, the punch receptacle 30 is now rotated further, the blanking punch 10 is moved out of the workpiece 50 counter to the blanking direction S. In order to apply the necessary force to the extraction tool 30, the latter advantageously has an engaging region 40', which serves for example for the arrangement of an open-end wrench. While the thread of the engaging portion 16 and of the arranging portion 32 is for example an M8 thread according to preferred embodiments, a width across flats of the engaging region 40' is for example 27 mm.

Figure 5:
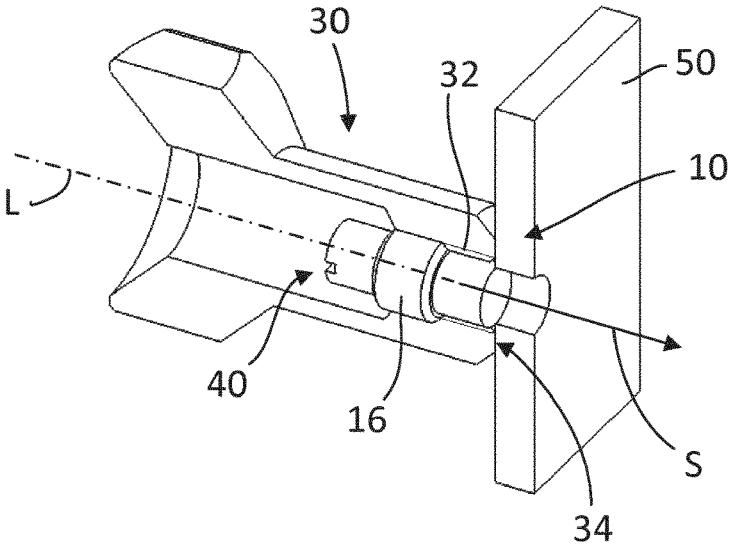
FIG. 5 is the extraction tool from FIG. 4 with the blanking punch fully removed from the workpiece.

Finally, FIG. 5 shows how the blanking punch 10 has now been removed from the workpiece 50 counter to the blanking direction S, wherein it is clearly apparent that, in particular as a result of the arrangement or support of the extraction tool 30 via its stop face 34 on the workpiece 50, exact moving out along the longitudinal axis L is possible without jamming or the like. Via an engaging region 40 in the blanking punch 10, the latter can now be screwed easily out of the punch receptacle 30. It is also apparent from this view, in particular compared with FIG. 4, that the arranging portion 32 is much longer than the engaging portion 16, thereby ensuring that the blanking punch 10 is securely retained in the punch receptacle 30 even after removal from the workpiece 50.

Figure 6:
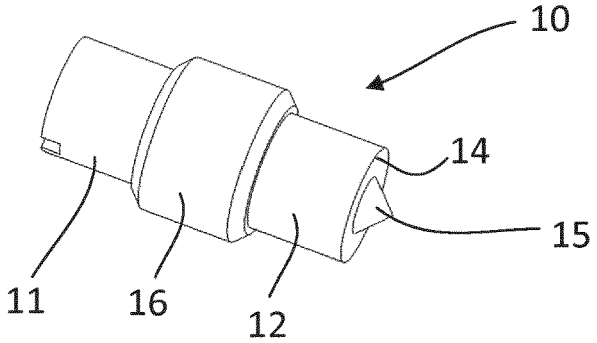
FIG. 6 is a further embodiment of a blanking punch.

FIG. 6 shows a further embodiment of a blanking punch 10, including a first portion 11, an engaging portion 16 and a second portion 12. Provided or arranged on the end of the second portion 12, which forms a cutting edge 14, is a point 15, with the result that the blanking forces can be reduced, since the flow properties of the workpiece are positively influenced thereby.

LIST OF REFERENCE SIGNS

10 Blanking punch
11 First portion
12 Second portion
14 Cutting edge
15 Point
16 Engaging portion
20 Punch receptacle
22 Pressure shoulder
30 Extraction tool
32 Arranging portion
34 Stop, stop face
40, 40' Engaging region

50 Workpiece
52 (Blanked) slug
60 Die
L Longitudinal axis
S Blanking direction The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A blanking punch, comprising:
a first portion;
a second portion extending away from the first portion in a blanking direction; and
an engaging portion longitudinally between the first portion and the second portion,
wherein
the second portion has a cutting edge,
the first portion has an axial end facing away from the blanking direction configured to receive a blanking force from a pressure shoulder of a blanking mandrel which supports the blanking punch during a blanking operation on a workpiece, and
the engaging portion is configured to be coupled to the blanking mandrel, and to be directly coupled to an extraction tool different from the blanking mandrel such that the blanking punch is extractable by the blanking punch from the workpiece in a direction counter to the blanking direction.

2. The blanking punch according to claim 1, wherein
the engaging portion is round in cross section and
the engaging portion has at least one circumferentially arranged engaging element that is oriented in an inclined manner along a longitudinal axis of the blanking punch.

3. The blanking punch according to claim 1, wherein the engaging portion is in the form of a thread.

4. The blanking punch according to claim 2, wherein the engaging portion is in the form of a thread.

5. The blanking punch according to claim 1, wherein a diameter of the first portion immediately adjacent to the engaging portion is smaller than an outside diameter of the engaging portion.

6. The blanking punch according to claim 4, wherein a diameter of the first portion immediately adjacent to the engaging portion is smaller than an outside diameter of the engaging portion.

7. The blanking punch according to claim 1, wherein the first portion has an engaging region for arrangement of a blanking punch driving tool.

8. The blanking punch according to claim 6, wherein the first portion has an engaging region for arrangement of a blanking punch driving tool.

9. A blanking mandrel, comprising:
a blanking punch according to claim 1; and
a punch receptacle in which the blanking punch is arranged.

10. The blanking mandrel according to claim 9, wherein the blanking punch is arrangeable in the punch receptacle via the engaging portion.

11. A blanking tool, comprising:
a blanking mandrel according to claim 9.

12. A blanking set, comprising:
a blanking tool according to claim 11; and
an extraction tool, wherein
the extraction tool has an arranging portion corresponding to the engaging portion, and a stop.

13. The blanking set according to claim 12, wherein the extraction tool is designed to effect extraction of the blanking punch from a workpiece by rotation.

14. The blanking set according to claim 12, wherein
the extraction tool is at least regionally in the form of a sleeve, and
the stop is in the form of a stop face on an end of the sleeve.

15. The blanking set according to claim 13, wherein
the extraction tool is at least regionally in the form of a sleeve, and
the stop is in the form of a stop face on an end of the sleeve.

16. The blanking set according to claim 12, wherein
the arranging portion is in the form of a threaded portion and
the arranging portion is at least as long as the engaging portion.

17. A method for blanking with a blanking punch having a first portion, a second portion extending away from the first portion in a blanking direction, and an engaging portion longitudinally between the first portion and the second portion, the engaging portion being configured to be coupled to a blanking mandrel which supports the blanking punch during a blanking operation on a workpiece and to be coupled to an extraction tool which removes the blanking punch from the workpiece in a direction counter to the blanking direction, comprising the acts of:
coupling the blanking punch to the blanking mandrel;
using the blanking mandrel to advance the blanking punch in the blanking direction during a blanking operation;
removing during the blanking operation a portion of a workpiece corresponding to a shape of the blanking punch as the blanking punch advances in the blanking direction;
removing the blanking mandrel from the blanking punch while the blanking punch remains in the workpiece after blanking;
installing an extraction tool onto the engaging portion of the blanking punch on a side of the workpiece from which the blanking mandrel was removed, until a stop on which the extraction tool is supported has been reached;
using the extraction tool to remove the blanking plug from the workpiece in a direction counter to the blanking direction.

* * * * *